US006193615B1

(12) United States Patent
Hirota

(10) Patent No.: US 6,193,615 B1
(45) Date of Patent: Feb. 27, 2001

(54) HEAD OF GOLF CLUBS THAT SPINS MORE

(76) Inventor: Atsunari Hirota, 2-29-17, Miyazawa-cho, Akishima city, Tokyo 196-0024 (JP)

( * ) Notice: Subject to any disclaimer, the term of this patent is extended or adjusted under 35 U.S.C. 154(b) by 0 days.

(21) Appl. No.: 09/188,453

(22) Filed: Nov. 9, 1998

(51) Int. Cl.[7] ..... A63B 53/04

(52) U.S. Cl. ..... 473/329; 473/331; 473/332; 473/350

(58) Field of Search ..... 473/329, 330, 473/331, 327, 332, 342, 350, 346, 349, 290

(56) References Cited

U.S. PATENT DOCUMENTS 1,854,548 * 4/1932 Hunt .
2,034,936 * 3/1936 Barnhart .
3,061,310 * 10/1962 Giza .
3,556,532 * 1/1971 Ballmer .
4,398,965 * 8/1983 Campau .
5,358,249 * 10/1994 Mendralla .
5,499,814 * 3/1996 Lu .
5,681,227 * 10/1997 Sayrizi .
5,766,092 * 6/1998 Mimeur .
5,766,094 * 6/1998 Mahaffey .

* cited by examiner

*Primary Examiner*—Sebastiano Passaniti

(57) ABSTRACT

A front face part of a golf club head is made thin plate-shape and existent grooves are on the front surface, gaps are established between the front face part and a head main body, and the front face part is combined with thin rib-shaped members only to the rear of the front surface portions of the front face part where the existent grooves are located and further the other ends of the rib-shaped members are combined with the head main body. By this structure, when hitting a ball in the rough, pressures become very high on edges of the grooves because it is hard around there. The edges cut off grass etc. and dig into a ball, and more backspin is produced.

2 Claims, 3 Drawing Sheets new
FIG. 1
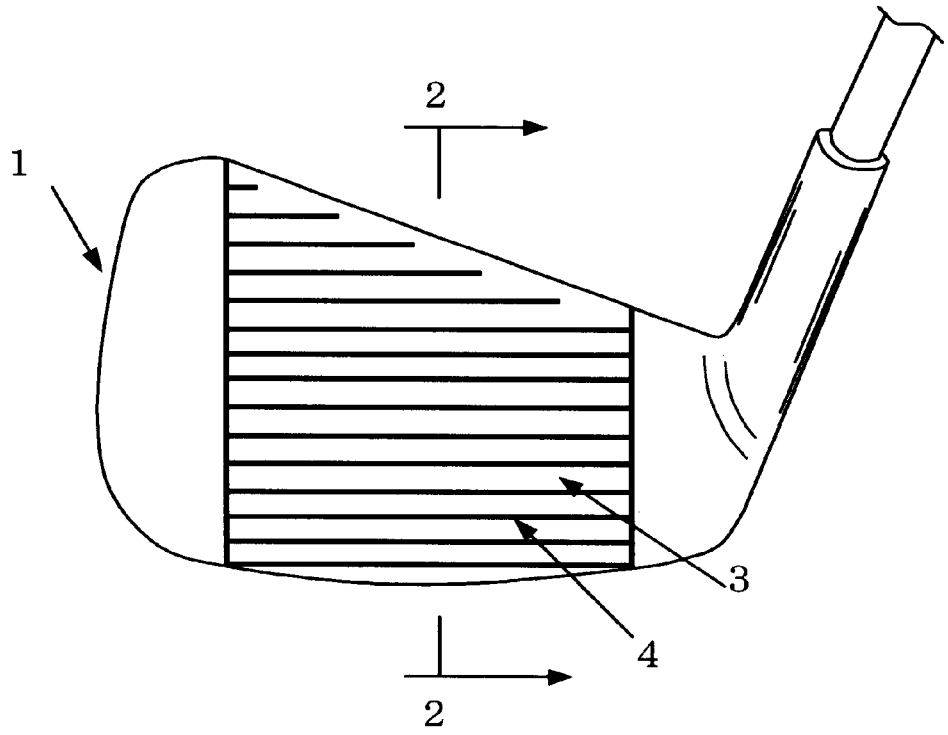

amended
FIG. 2
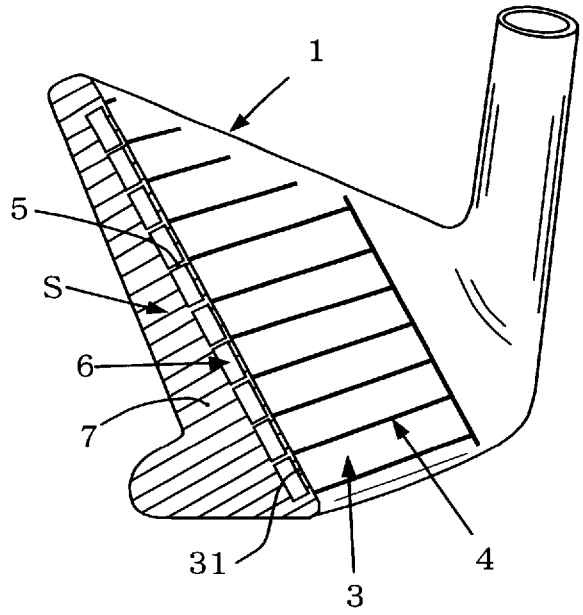

new
FIG. 4
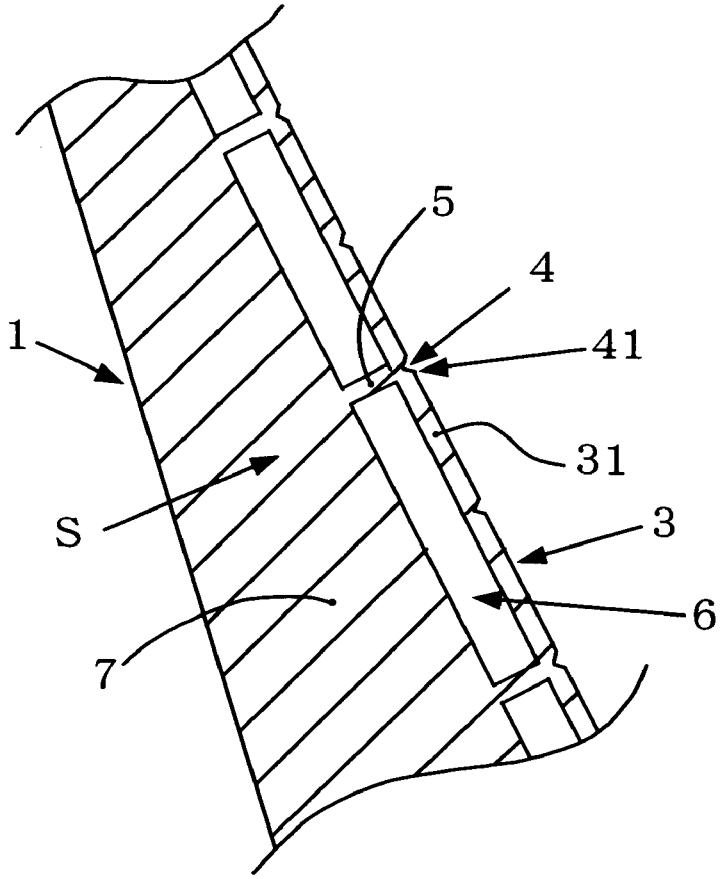

HEAD OF GOLF CLUBS THAT SPINS MORE

CROSS-REFERENCE TO RELATED APPLICATIONS

Not Applicable.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

1. Technical Field

This invention relates to a head of golf clubs that is able to spin a ball more when hitting the ball in the rough etc.

2. Description of the Related Art

Many grooves are carved on a clubface in order to spin a ball enough even when substances such as grass or moisture lie between the ball and the clubface.

However, enough backspin is not produced in the rough etc. actually, the ball flies to unexpected longer distance or does not stop on the green (i.e. so-called "flyer phenomenon" occurs), and it annoys golfers.

Accordingly the golf club that is able to spin a ball more even in such a situation is requested. But any effective methods are not suggested yet.

BRIEF SUMMARY OF THE INVENTION

In this invention, a front face part of a head is made thin plate-shape and a gap (space) is established between the front face part and a head main body, and the front face part is combined with thin rib-shaped members only to the rear of the front surface portions of the front face part where the grooves are located and the other ends of the rib-shaped members are combined with the head main body.

If such a structure is adopted in a head of golf clubs, stiffiess of the vicinity of the grooves is very high and of the other part is very low. Therefore, when hitting a ball in the rough etc., pressures acting on the vicinity of the grooves are very high and on the other parts are very low. Consequently, edges of the grooves cut off the grass etc. and dig into the ball, then more backspin is produced.

BRIEF DESCRIPTION OF THE SEVERAL VIEWS OF THE DRAWING

The invention disclosed herein will be understood better with reference to the following drawings of which:

FIG. 1 is a perspective view of the club head in accordance with this invention;

FIG. 2 is a perspective view of the club head sectioned along the line 2—2 in FIG. 1;

FIG. 4 is in case of that the rib-shaped members are established on every other portion, and is a modified example of FIG. 3.

DETAILED DESCRIPTION OF THE INVENTION

Figure 3:
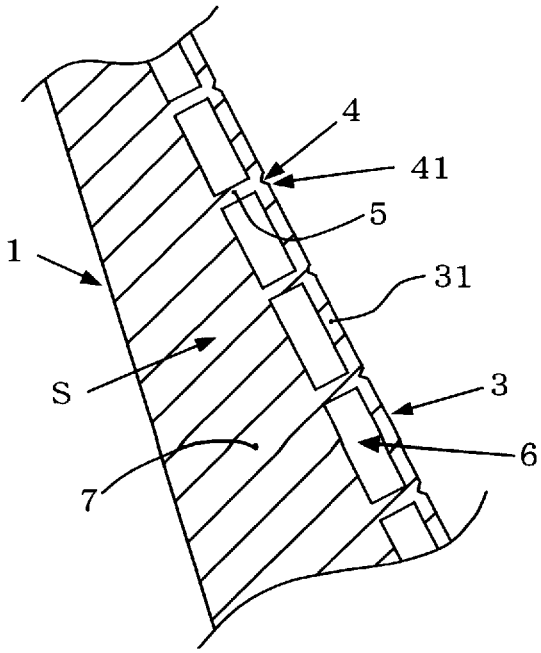
FIG. 3 is an enlarged view in part of the sectional surface S in FIG. 2.

Referring more particularly to the invention.

An embodiment of this invention is explained with drawings as follows.

In FIG. 1, a club head 1 has a front surface 3 and many existent grooves 4 on the front surface 3.

In FIGS. 2 and 3, a front face part 31 is made very thin plate-shape and is very flexible. Between the front face part 31 and a head main body 7 is spaced and exists gaps 6. And the front face part 31 is combined with thin rib-shaped members 5 only to the rear of the front surface portions of the front face part 31 where the grooves 4 are located, and the other ends of the rib-shaped members 5 are combined with the head main body 7.

Further it is good that the thin rib-shaped members are established on every other portion or on every third portion. In FIG. 4, an example is explained that the thin rib-shaped members 5 are established on every other portion.

By this structure, the rigidity of the vicinity of the grooves 4 is high because the rib-shaped members 5 combine the front face part 31 with the head main body 7 only in the rear portions with the grooves, so forces (pressures) intensively act on the edges 41 of the grooves 4 and the pressures become very high. When hitting a ball in the rough, capability to cut off the grass etc. improves and more backspin is produced.

What is claimed is:

1. A golf club including a head, said head comprising:

a thin plate-shaped front face part having existent grooves on the front surface;

gaps between said thin plate-shaped front face part and a head main body; and thin rib-shaped members to combine said thin plate-shaped front face part and said head main body only to the rear of the front surface portions of said thin plate-shaped front face part where said existent grooves are located.

2. The golf clubs of claim 1 in which said thin rib-shaped members are established to the rear of every other portion or on every third portion.

* * * * *